US006402539B1

(12) United States Patent
Toth et al.

(10) Patent No.: US 6,402,539 B1
(45) Date of Patent: Jun. 11, 2002

(54) SELF-CONTAINED UNDERWATER CABLE BRANCHING APPARATUS AND METHOD

(75) Inventors: John R. Toth, Clermont; Ronald Gerald Wayne, Ormond Beach, both of FL (US)

(73) Assignee: Ocean Design, Inc., Ormond Beach, FL (US)

( * ) Notice: Subject to any disclaimer, the term of this patent is extended or adjusted under 35 U.S.C. 154(b) by 0 days.

(21) Appl. No.: 09/982,228

(22) Filed: Oct. 16, 2001

(51) Int. Cl.[7] ..... H01R 13/62; H01R 13/44
(52) U.S. Cl. ..... 439/367; 439/138; 439/275
(58) Field of Search ..... 439/367, 138, 439/273, 201, 587, 272, 275

(56) References Cited

U.S. PATENT DOCUMENTS

| | | | | |
|---|---|---|---|---|
| 4,874,326 A | * | 10/1989 | Marolda, Jr. | 439/273 |
| 4,909,751 A | * | 3/1990 | Marolda, Jr. | 439/273 |
| 5,470,248 A | * | 11/1995 | Wood | 439/281 |
| 5,704,799 A | * | 1/1998 | Wood | 439/281 |
| 5,738,535 A | * | 4/1998 | Cairns | 439/138 |
| 5,873,750 A | * | 2/1999 | Cairns et al. | 439/587 |
| 6,017,227 A | * | 1/2000 | Cairns et al. | 439/138 |
| 6,332,787 B1 | * | 12/2001 | Barlow et al. | 439/138 |

OTHER PUBLICATIONS

Perry Joseph Wright, "Optical Fiber's Gigabit Bandwidth, 200 km Range Attractive for Subsea Work", Offshore, May 2000.

Stewart Barlow, "Advances in Undersea Connector Technology Improve Efficiency", Lightwave Special Reports, Oct. 1999.

* cited by examiner

*Primary Examiner*—Tulsidas Patel
(74) *Attorney, Agent, or Firm*—Brown, Martin, Haller & McClain, LLP

(57) ABSTRACT

A cable branching apparatus for installation underwater has a circuit distribution unit with first and second ports connected to respective cables, and at least two additional, third and fourth ports. A switch assembly in the circuit distribution unit selectively connects the first port to the second port in a straight through arrangement, or the first and second ports to the third and fourth ports, respectively, in a branching configuration. At least two wet mateable underwater connectors each comprise a dummy unit and an active unit releasably secured to the dummy and connected to a respective one of the third and fourth ports. Branch cables can be selectively connected to one or both cables underwater simply by separating one or both dummy units from the active units, and connecting the active units to mating connector units at the end of branch cables, using an ROV.

16 Claims, 6 Drawing Sheets

SELF-CONTAINED UNDERWATER CABLE BRANCHING APPARATUS AND METHOD

BACKGROUND OF THE INVENTION

The present invention relates generally to underwater electrical and/or fiber-optic cable systems, such as underwater telecommunication systems, and is particularly concerned with an apparatus and method for providing branching and re-distribution of circuits in such a system after installation.

Currently, it is very difficult to re-connect or re-distribute circuits when an electrical/optical cable system has been previously submerged deep underwater, such as on the ocean floor. The present technology involves grappling and retrieval of cables from the ocean floor, such that they often have to be drawn up from several miles of ocean depth, and subsequently separated and re-terminated via splicing on board a cable laying ship, using ship-board facilities. This procedure is extremely laborious, time-consuming and expensive. Also, such procedures are very vulnerable to weather and ocean conditions, since storms or other inclement weather conditions can severely limit or jeopardize the successful completion of such operations.

SUMMARY OF THE INVENTION

It is an object of the present invention to provide a new and improved self-contained cable branching apparatus and method for ocean floor installation.

According to one aspect of the present invention, an ocean floor cable branching apparatus is provided, which comprises a cable junction housing for positioning in-line between two main cables for installation underwater, the housing having a first junction at one end having a through bore for receiving the end of a first cable and a second junction at the opposite end having a through bore for receiving the end of a second cable, a circuit distribution unit inside the housing having a first port connected to the end of the first cable, a second port connected to the end of the second cable, and at least two additional, third and fourth ports, a switch assembly in the circuit distribution unit for selectively connecting the first port to the second port in a straight through arrangement, and connecting the first and second ports to the third and fourth ports, respectively, at least two wet mateable underwater connectors in the housing each comprising a plug unit and a socket unit releasably connected with the plug unit, one of the units comprising a dummy unit and the other unit being connected to a respective one of the third and fourth ports, and a connector mounting mechanism in the housing for movably mounting the respective plug and socket units for movement between an inactive, stowed condition in which each plug unit is aligned with and connected to the respective socket unit, and a released, deployed condition in which the plug and socket units are separated, the dummy unit is discarded, and the remaining unit is deployed for selective connection to a mating unit at the end of a branch cable to be connected to one of the main cable ends.

In an exemplary embodiment of the invention, there are four additional ports and four underwater connectors, each with an active unit connected to a respective one of the additional ports. Some or all of the connectors may be disconnected, with the dummy unit discarded and the active unit connected to a respective branch cable, and the circuit distribution unit appropriately switched to connect each branch cable to respective circuits in a selected main cable, providing a selected circuit configuration. In an even more versatile arrangement, two identical housings are connected in line in a tandem arrangement, with each housing containing a circuit distribution unit and associated underwater connectors.

In an exemplary embodiment of the tandem arrangement, each housing has a spherical or ball joint arrangement at each end, with a central, double ball joint between the two housings, providing a wide range of articulation. Each housing may be capable of articulating to 90 spherical degrees or more. The entire assembly is designed to be axially mounted into a length of oceanic cable, and to be deployable over a standard cable-laying sheave, making installation easy and inexpensive.

The or each housing has at least one opening for access to the connectors, and one or more doors for normally closing the opening, which can be opened by a remote oceanic vehicle (ROV) when the cable ends are to be re-connected to branch cables. The ROV can manipulate the connector mounting mechanism in order to disconnect the connector units, discard or retrieve the dummy units, and connect the port connector units to one or more branch cables. Additionally, the ROV can be controlled to adjust the circuit handling unit to accommodate the new circuit configuration. The connectors may be wet mateable underwater optical or electro-optical connectors which are designed for sealed, releasable underwater connection of electrical and/or optical fiber circuits in underwater cables. Suitable wet mateable connectors are described, for example, in U.S. Pat. Nos. 5,738,535 or 6,017,227 of Cairns, or pending U.S. patent application Ser. No. 09/641,313 of Barlow et al., Ser. No. 09/418,145 of Cairns filed Oct. 14, 1999 or Ser. No. 09/761,917 of Cairns et al. filed Jan. 17, 2001.

According to another aspect of the present invention, a method of releasably connecting the ends of two cables in-line and subsequently separating the cable ends and joining them to branch cables is provided, which comprises the steps of:

- securing an end of a first cable to a first port of a circuit distribution unit mounted inside a housing;
- securing an end of a second cable to a second port of the circuit distribution unit with the circuit distribution unit arranged to connect the first port to the second port;
- securing first and second underwater connectors to third and fourth ports of the circuit distribution unit inside the housing, with each connector comprising an active connector unit connected to the respective port and a dummy unit releasably connected to the active connector unit;
- deploying the cables and housing underwater as part of a sub-oceanic cable communication network;
- at a subsequent date, disconnecting at least one dummy unit from the corresponding active unit, and connecting the active unit to a mating connector of a branch cable; and
- adjusting the circuit distribution unit to connect the branch cable to one of the in-line cables.

In an exemplary embodiment, both of the dummy units are disconnected from the respective port connector units and discarded, and separate branch cables are connected to the respective port connector units, with the circuit distribution unit being adjusted to connect one of the branch cables to one of the in-line cables, and the other branch cable to the other in-line cable.

The method and apparatus of this invention allows installation of branching devices along each line when laying a new, sub-oceanic cable network for telecommunications or the like. Subsequent branching and re-circuiting can then be readily performed by an ROV on the ocean floor at any desired branching apparatus location. Further revisions can be made at a later date, whenever required, substantially increasing the flexibility and modification capabilities of such systems. The performance of modifications and additions on the ocean floor by an ROV will significantly reduce the hazards to both equipment and personnel, by avoiding the need to raise a previously laid cable through possibly miles of ocean depth onto a cable laying ship, and then separate and re-splice the cable on board the ship. Branching and re-circuiting operations, as well as initial installation, will be less vulnerable to adverse weather conditions which can otherwise cause substantial, and expensive, delays in such operations.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
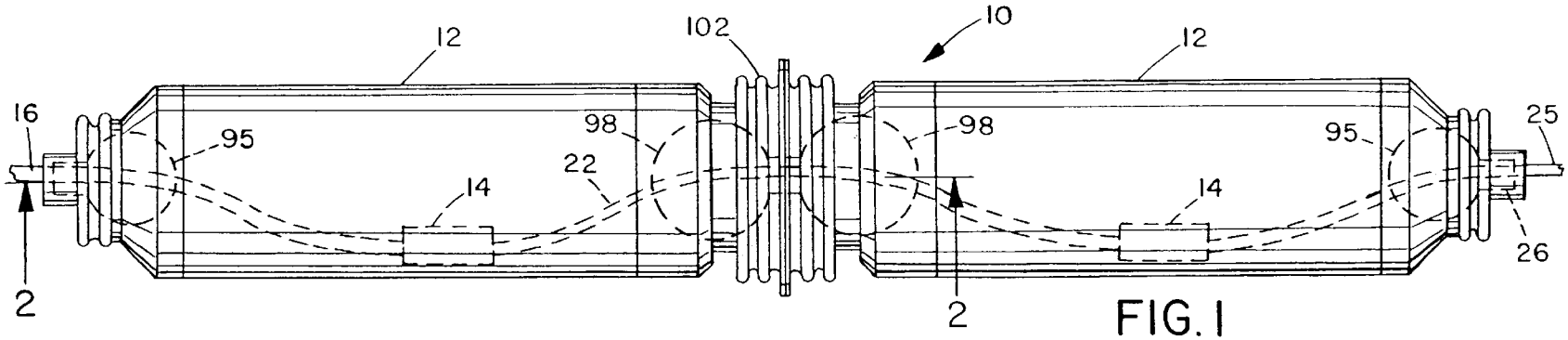
FIG. 1 is a side view of a tandem connector assembly according to an exemplary embodiment of the invention.

FIG. 1 of the drawings illustrates a tandem underwater branching apparatus 10 according to an exemplary embodiment of the invention for installation in a sub-oceanic cable communication network, while FIGS. 2 to 7 illustrate one of the two cylinders or housings 12 of FIG. 1 in more detail, with the two cylinders being of identical construction. FIGS. 11 to 14 are diagrammatic views of one of the cylinders 12 illustrating a sequence of steps in a cable branching operation which may be carried out by a remote oceanic vehicle, as discussed in more detail below. This application is related to co-pending application Ser. No. 09/944,490 of Toth, et al. filed Aug. 30, 2001, and entitled Underwater Cable Branching Apparatus and Method". However, the branching apparatus of this invention is a self-contained unit, and provides for more re-circuiting options.

Figure 10:
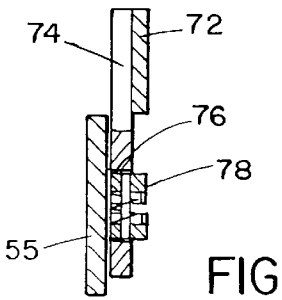
FIG. 10 is a sectional view taken on line 10—10 of FIG. 9.
Figure 11:
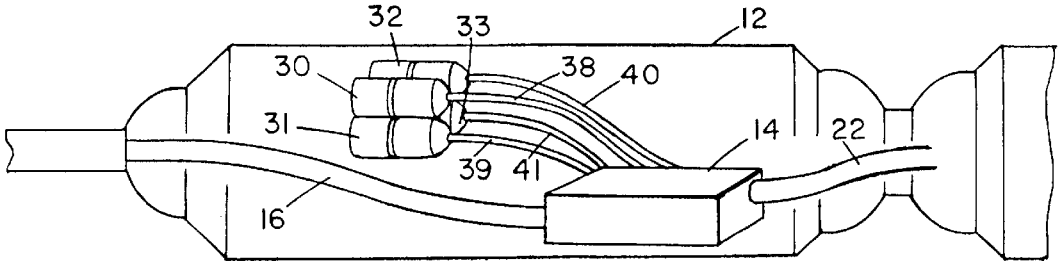
FIG. 11 is a diagrammatic view of one connector housing in the closed position.
Figure 15:
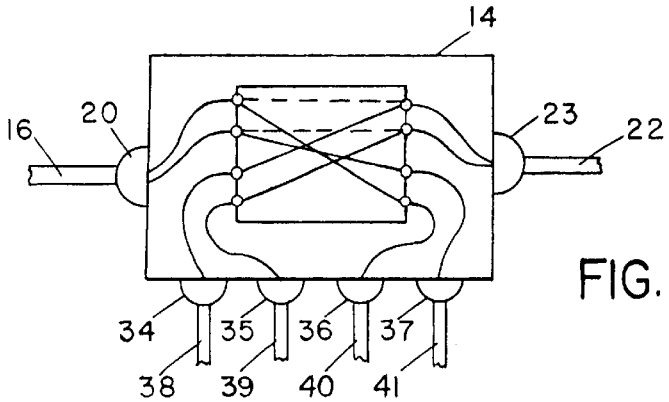
FIG. 15 is a diagram of the circuit distribution unit.

As best illustrated in FIG. 11, and in dotted outline in FIG. 1, each of the cylinders 12 contains a circuit distribution unit 14, illustrated in more detail in FIG. 15. A first main cable 16 extends through a port 18 at one end of the first housing or cylinder 12, and is terminated at a first port 20 of the unit 14. A connector cable 22 extends between second port 23 of the unit 14 and the first port 20 of the circuit distribution unit 14 in the second cylinder of the tandem apparatus, via through port 24 between the cylinders 12. A second main or in-line cable 25 extends through a port 26 at the outer end of the second cylinder, and is terminated at the second port 23 of the unit 14 in that housing. It should be noted that the cables 16, 22 and 25 are omitted in FIGS. 2 to 10 for clarity in showing the remainder of the branching mechanism.

Each housing also contains four wet-mateable underwater connectors 30,31,32,33, each comprising a plug unit 34 releasably securable to a socket unit 35. One unit of each connector is an inoperative dummy simply for retaining the other unit in a closed and sealed condition when not operative, while the other unit is wired to a respective port of the circuit distribution unit as indicated in FIGS. 11 and 15. In the illustrated embodiment, the dummy is the receptacle unit while the operative, wired unit is the plug unit of the connector, although this arrangement may be reversed in other embodiments. As indicated in FIG. 15, the circuit distribution unit 14 has four additional ports 34,35,36, and 37 each connected to the plug unit 34 of a respective one of the connectors 30,31,32, and 33 via connecting leads 38,39, 40,41, respectively.

Figure 4:
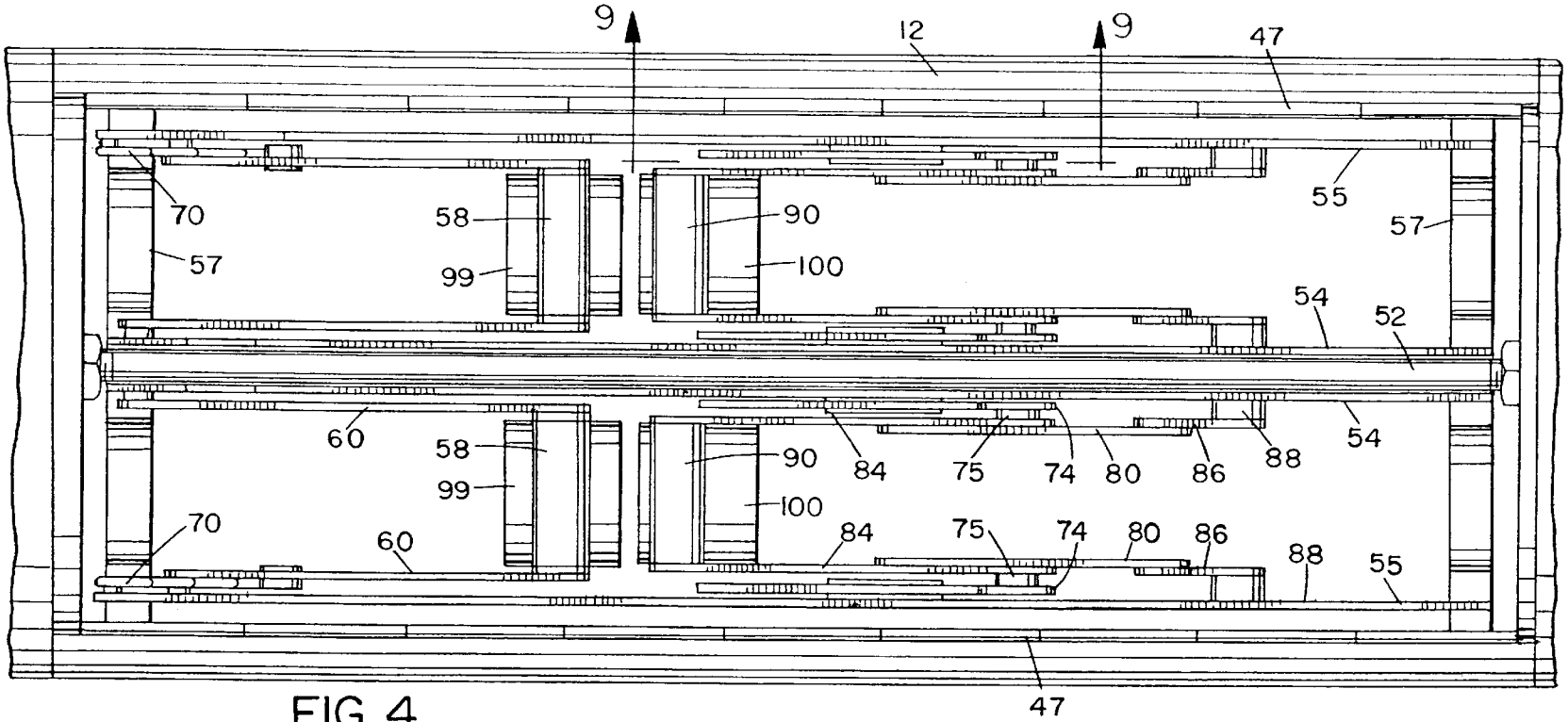
FIG. 4 is a top plan view of the structure of FIG. 3, with the doors omitted.
Figure 5:
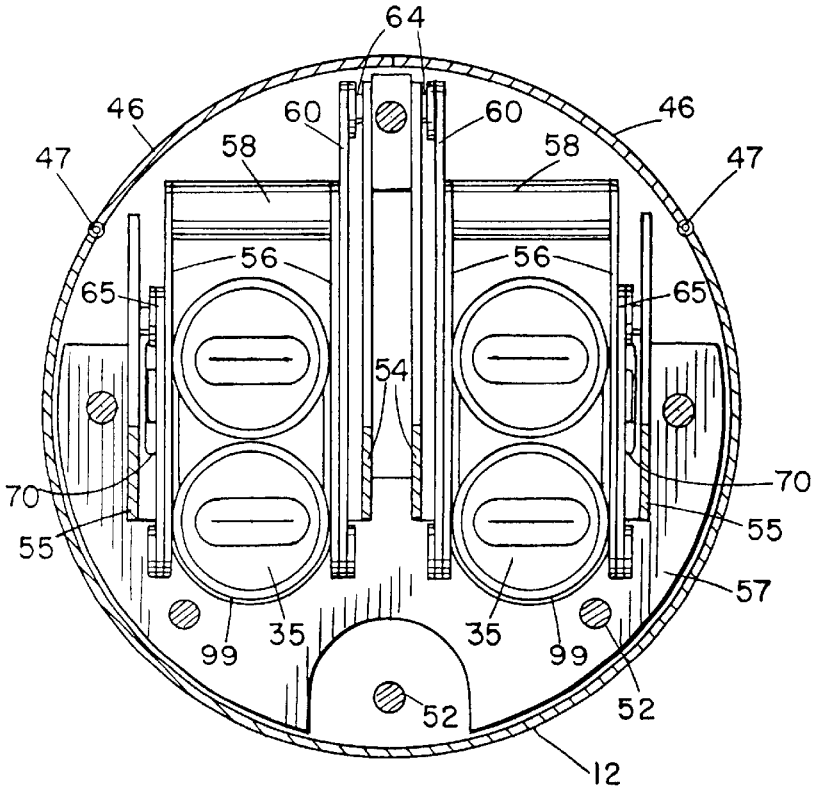
FIG. 5 is an enlarged sectional view taken on line 5—5 of FIG. 2.
Figure 6:
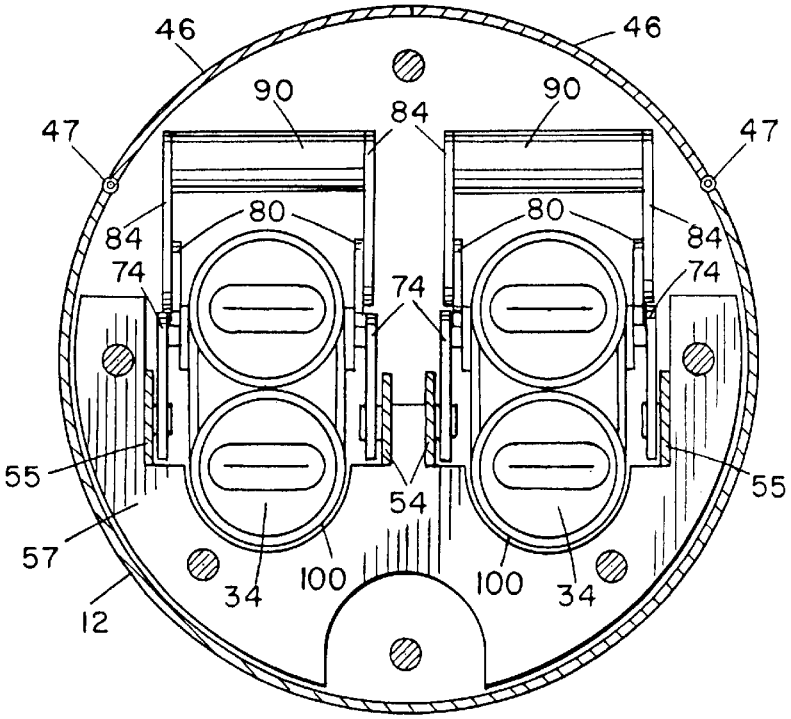
FIG. 6 is an enlarged sectional view taken on line 6—6 of FIG. 2.

The connector units are mounted in pairs, in connector mounting tubes 99, 100, each pair comprising a lower connector and an upper connector stacked on top of the lower connector. The two pairs of connectors are mounted side by side in the housing, as indicated in FIGS. 4, 5, and 6. Each pair of connectors is mounted in the housing on a pivotal linkage or deployment assembly having a first part 42 on which the dummy connectors 35 are mounted in tubes 99, and a second part 44 on which the plug units 34 are mounted in tubes 100. The pivotal linkage assembly is arranged to allow the respective plugs and sockets to be disconnected and separated, and raised up out of the housing as indicted in FIG. 3, as will be described in more detail below. The connector mounting tubes each have an internal, universal mechanical anchorage device designed to be compatible to the secure mounting of either a plug unit, a receptacle unit, or a dummy unit.

Figure 8:
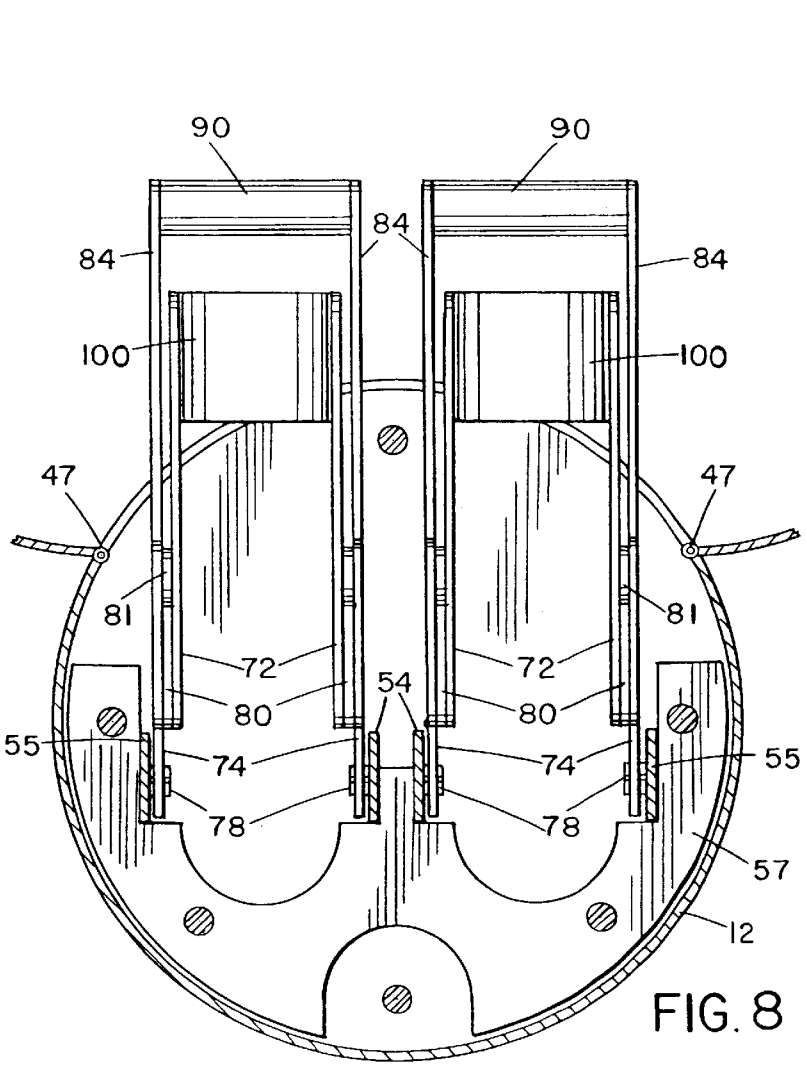
FIG. 8 is a view similar to FIG. 6, but with the mechanism extended.
Figure 7:
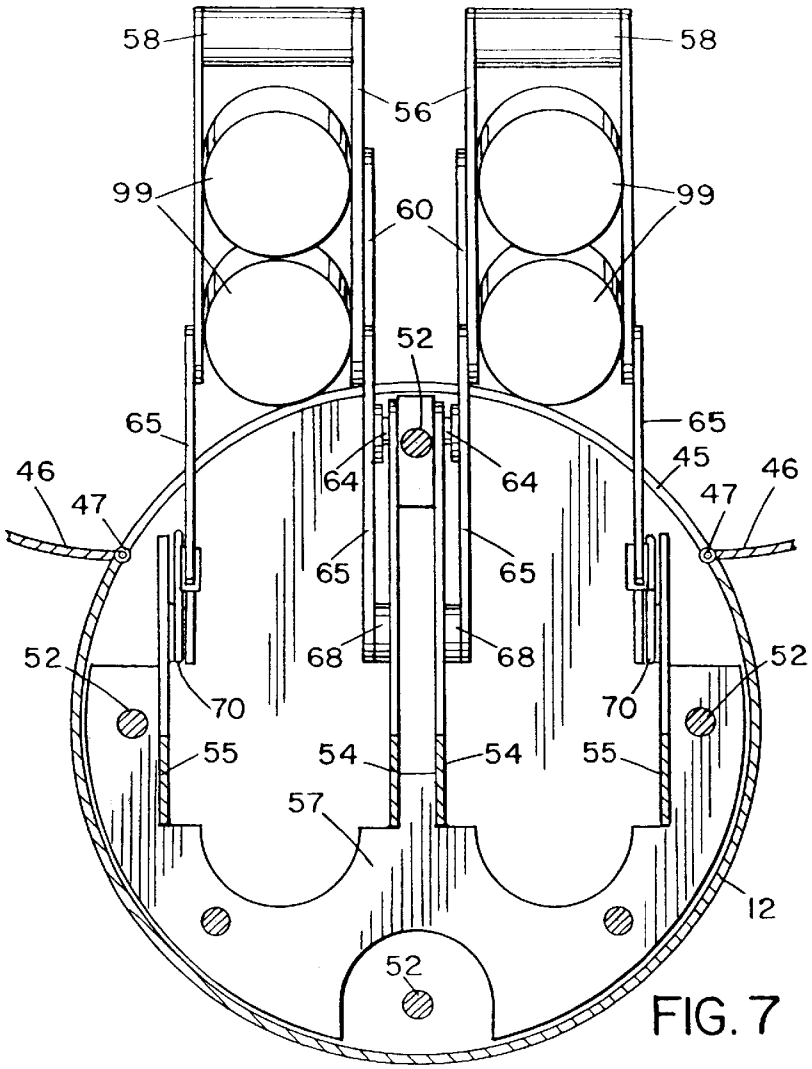
FIG. 7 is a view similar to FIG. 5, but with the mechanism extended.

The housing 12 has an upper opening 45 extending along a major portion of its length and around approximately 120 degrees of the circumference of the housing, as best illustrated in FIGS. 7 and 8. The housing is normally covered by a pair of hinged doors 46, secured to the sides of opening 45 via hinges 47, as indicated in FIGS. 5 and 6. Doors 46 may be opened by an ROV into the open position illustrated in FIGS. 7 to 8 to allow the connector units to be separated and moved from the stowed, inoperative position within the housing into the extended or deployed position outside the housing. A frame assembly is mounted in the housing for structural support of the pivotal linkage assemblies. The frame basically comprises a pair of end plates or bearing frames 48 adjacent each end of the housing, each end plate having an opening 50 for passage of the respective cables, and a series of support rods 52 extending between the end plates. A pair of side rails is associated with each of the two pivotal linkage assemblies arranged side-by-side in the housing, each pair comprising an inner rail 54 and an outer rail 55 extending between opposite ends of the housing and supported on end support plates 57, as best illustrated in FIGS. 3 and 4.

The pivotal linkage assemblies are illustrated in more detail in FIGS. 2 to 8. The first part 42 of each pivotal linkage assembly, which supports the respective pair of dummy connector units or sockets 35, includes a first pair of linkage arms 56 between which the two dummy connector units 35 are secured in mounting tubes 99, in a vertically stacked, generally horizontal orientation when in the inoperative or stowed position inside the housing, indicated in dotted outline in FIG. 3. The upper ends of the arms 56 project upwardly from the uppermost connector unit 35, and are secured together by a first handle 58 (see FIG. 5). A second pair of parallel linkage arms 60 are each pivotally secured at one end to an intermediate position on a respective one of the arms 56 via pivots 62, and are pivotally secured to the respective inner and outer rails 54,55 at their opposite ends, via pivots 64. A third pair of parallel linkage arms 65 are each pivoted to the lower end of the respective arms 56 at one end via pivots 66. The opposite end of each linkage arm 65 is pivoted to the respective inner and outer rails at a location spaced below the pivots 64, via pivot 68. An over center spring 70 secured at one end to the respective outer rail extends around pivot 68 and is secured to the respective outer linkage arm 65 at its second end, so as to urge the arm 65 into the extended position illustrated in full lines in FIG. 3, in which the dummy connector units 35 are raised upwardly out of the housing.

Figure 2:
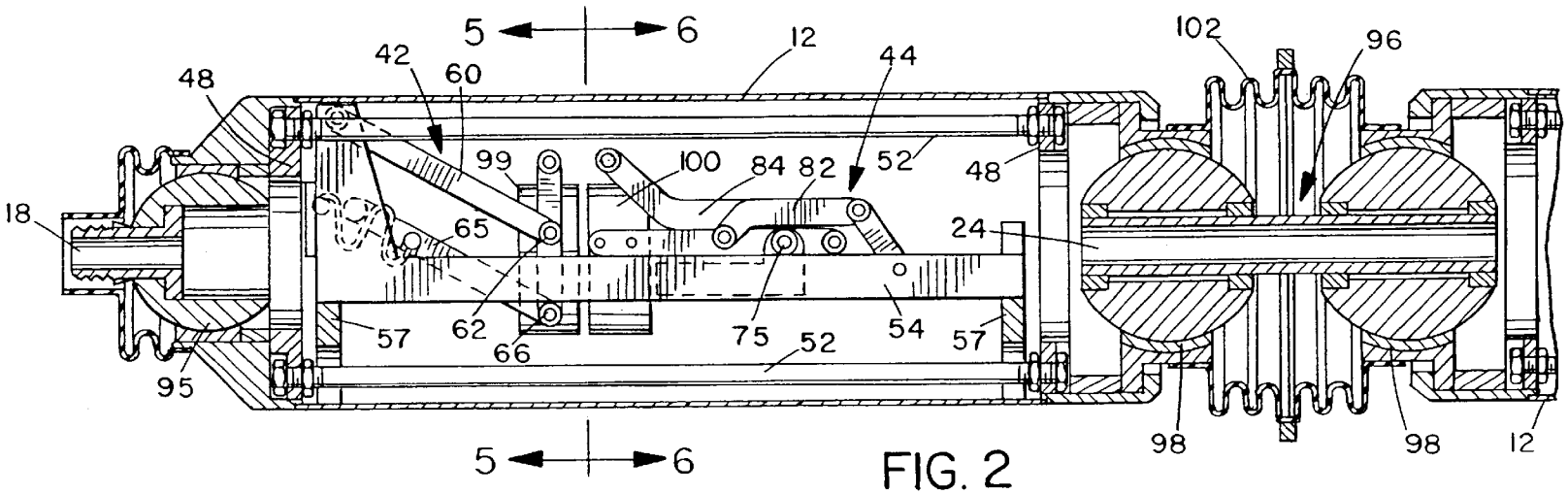
FIG. 2 is an enlarged sectional view taken on line 2—2 of FIG. 1.
Figure 3:
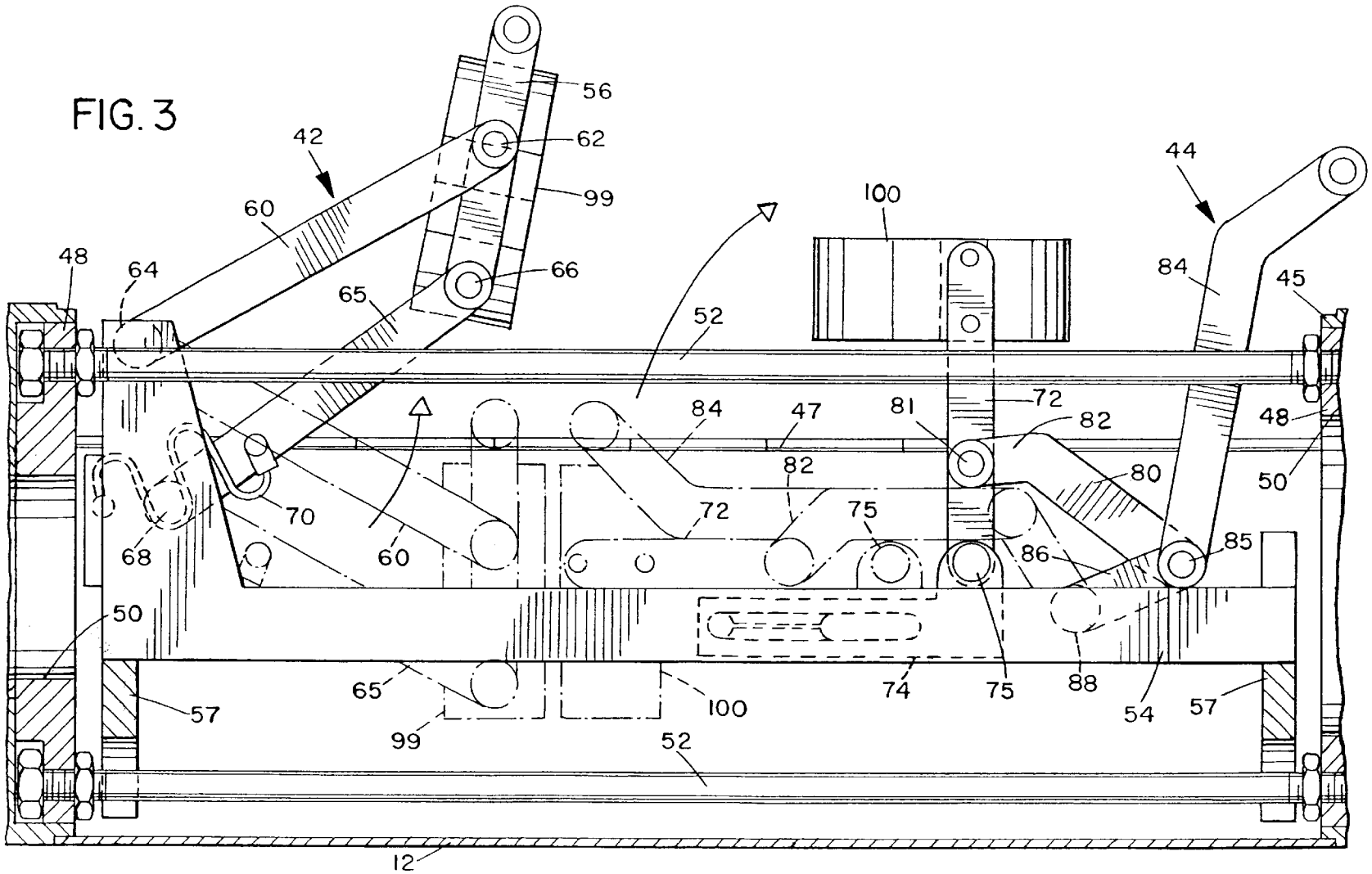
FIG. 3 is a further enlargement of a portion of FIG. 2 showing the retracted and extended positions of the mechanism.
Figure 9:
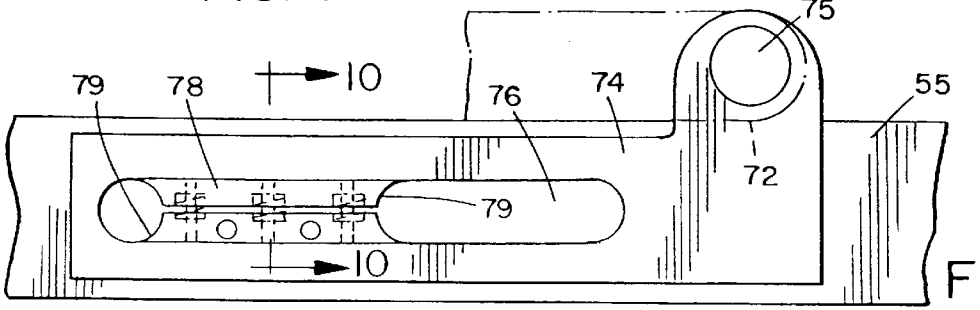
FIG. 9 is an enlarged sectional view taken on line 9—9 of FIG. 4.

The second part 44 of each pivotal linkage assembly mounts a vertically stacked, parallel pair of connector or plug units 34 in mounting tubes 100 for movement between the retracted, stowed position within the housing, as illustrated in FIGS. 2 and 6, and in dotted outline in FIG. 3, and the raised, vertically oriented or deployed position illustrated in FIG. 8 and in solid outline in FIG. 3. The second part 44 includes a first pair of linkage arms 72 positioned one on each side of plug units 34 with their ends bolted or otherwise secured to the mounting tubes 100. The opposite end of each arm 72 is pivoted to a movable slide plate or element 74 via pivot 75. As best illustrated in FIGS. 9 and 10, the movable slide plate 74 has an elongate slot 76 in which a snow-plow slide element 78 is slidably engaged. The slide element 78 is in turn secured to the respective inner or outer rail 54,55. It can be seen that the end faces 79 of the slide element 78 are snow-plow shaped so as to dislodge any accumulated debris from the slot 76. As illustrated in FIGS. 9 and 10, the snow plow or shovel slide element 78 is made in two halves, which are spring loaded away from one another, so that they bear against the opposite sides of slot 76. This ensures that the pointed or sharp ends of the element 78 will scrape along the sides of slot 76 as the slide plate 74 moves back and forth, removing any accumulated debris.

A second pair of linkage arms 80 each have a first end pivoted to an intermediate point on a respective one of the arms 72 via pivot 81 and have an angled end portion 82 pivoted at its free end to the end of a respective one of a pair of third, handle arms 84 via pivot 85. A pair of short, fourth linkage arms 86 are also pivoted to pivot 85 at one end, and to the respective side rail 54,55 at the oopposite end, via pivot 88. Each handle arm 84 has a free end secured to the other handle arm via handle shaft 90, as best illustrated in FIGS. 4, 6 and 8.

When the two parts 42, 44 of the pivotal linkage assemblies for the plug units 34 and dummy units 35 are in the lowered, stowed position of FIGS. 2, 5 and 6, as also illustrated in dotted outline in FIG. 3, the plug units 34 are aligned with the dummy socket units 35 and releasably secured to the socket units, so that the respective terminals are sealed. In this position, the handle arms 84 lie horizontally over the horizontal connector mounting arms 72. The handle end of each arm 84 is angled upwardly in this position, to permit the handle 90 to be gripped more readily. The handle 58 of the first part 42 is also spaced upwardly above tubes 99 for gripping readily by an ROV.

Figure 13:
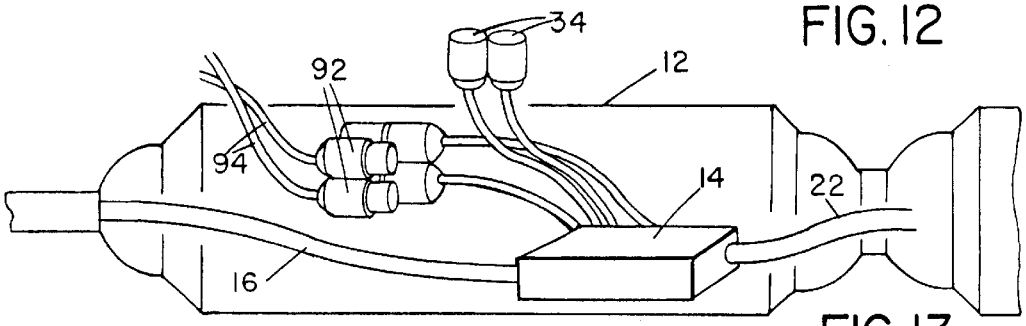
FIG. 13 is a similar view with new branch connectors installed.

In order to release the connector units and raise the plug units 34 out of the housing, into the raised, deployed position of FIGS. 3 and 8, an ROV must first open the hinged doors 46. At this point, a handle 90 is gripped and rotated upwardly and outwardly in a clockwise direction, as indicated by the arrow in FIG. 3, in order to move the handle 90 and arms 84 from the dotted line position into the solid line position. At the same time, this pulls the linkage arms 80 rearwardly, simultaneously pulling back arms 72 and rotating them upwardly into the vertical position of FIG. 3, retracting the plug units 34 away from the dummy units 35 and raising units 34 upwardly out of the housing. The rearward motion of arms 72 is permitted by sliding of slide elements 74 rearwardly from the solid line position to the dotted line position. This procedure may be repeated for both pairs of plug units, if all four plug units are to be connected to branch cables, or for only one pair of plug units. At this point, the plug units 34 are ready for connection to the mating receptacle or socket units 92 of branch cables 94, as indicated in FIGS. 13 and 14.

Figure 12:
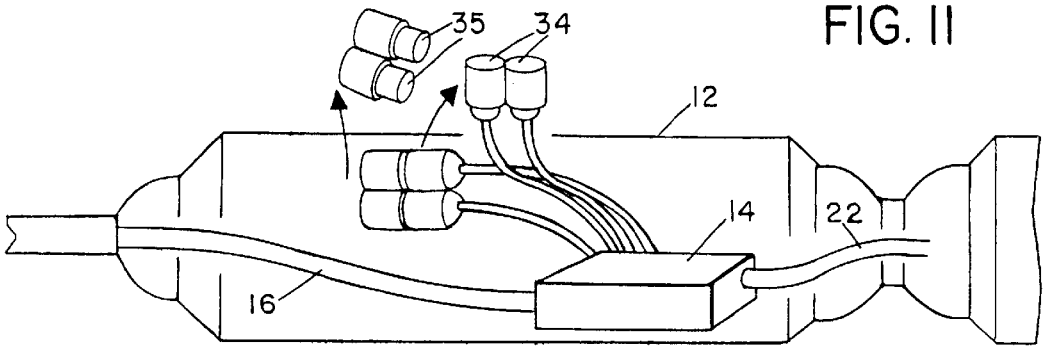
FIG. 12 is a similar view with the connector elements separated and extended.

After retracting and raising plug units 34, the ROV then grips the handle 58 of the disconnected socket or dummy units 35, and rotates the handle, and thus the arms 56 and attached dummy units 35, upwardly and out of the housing. The dummy units may be removed from the mounting tubes 99 and discarded, as indicated in FIG. 12. When the plug units 34 have been re-connected to receptacle units 92 of branch cables 94, after inserting the receptacle units in the associated mounting tubes 99, the attached connectors may be lowered back into the first position within the housing by suitable manipulation of the handles 58 and 90. The hinged doors 46 may then be closed. The doors may have suitable cut-outs (not illustrated) for the cables 94 to exit the housing.

Figure 14:
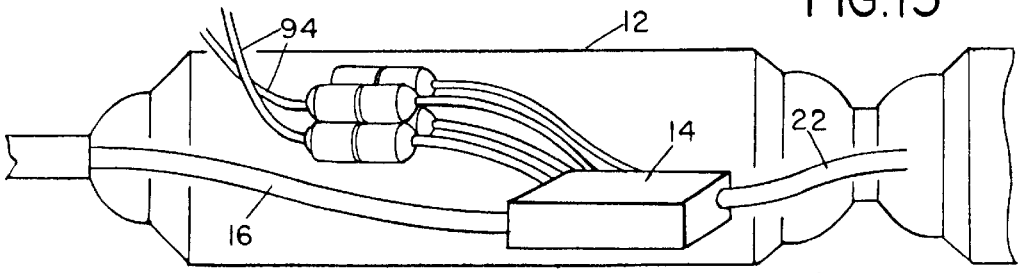
FIG. 14 is a similar view with the connector elements reconnected.

Before closing doors 46, the ROV will also manipulate the circuit distribution unit 14 via switches provided on the unit in order to switch from the straight through configuration indicated in dotted outline in FIG. 14, into the branch or crossover configuration illustrated in solid outline. In the branch configuration, port 20 is connected to ports 36 and 37, which are connected in turn to branch cables 94. Similarly, other branch cables are connected via ports 34 and 35 to port 23.

In the illustrated embodiment, as noted above, two identical cylinders 12 are connected in tandem, for increased versatility in connection points for branch cables and associated devices. A spherical, articulating U-joint element 95 is provided at the outer end of each cylinder 12, as indicated in FIGS. 1 and 2, and a double U-joint element 96, pivoting on twelve inch centers, is provided as a central bending mechanism between the two cylinders. The double U-joint comprises two ball joints 98 with a flexible, bellows like seal 102 between the joints. Port or cable passageway 24 extends through the ball joints as illustrated in FIG. 2 in order to connect the two cylinders. This arrangement provides an overall range of 180 spherical degrees of movement. The end joints 95 are each capable of articulating to 90 spherical degrees or more. This enables the entire apparatus to be deployed underwater from a standard cable-laying sheave. A branching apparatus of this type may be provided at spaced intervals along an entire length of cable, for later branching or re-circuiting.

Even when the hinged doors 46 of the or each housing 12 are closed, it will be understood that the interior of the housing is not sealed and water tight, and that sea water will therefore be able to enter the housing. However, the connector deployment mechanism must be cable of reliable manipulation at various intervals of time, regardless of the extended deep sea water submersion. In view of this, each sliding or pivotal mechanism must either be sealed or resistant to build up of deposits over time. Thus, the sliding mechanism is equipped with snow-plow slide elements for clearing debris from the slide slot, as discussed above. At the same time, each of the pivot bearings of the pivotal linkages is a dynamically sealed pivot bearing, capable of resisting the pressure levels encountered at deep sea depths.

The connector units 92 and 34 may comprise mateable socket and plug units of an underwater optical, electrical, or electro-optic connector which is designed for sealed, releasable underwater connection of electrical and/or optical fiber circuits which are terminated to the respective terminals in the two mating connector halves. The dummy connector unit 35 will be identical in all respects to the operative receptacle unit 92, except that it will have no active circuit connections. Suitable wet-mateable connectors are described, for example, in U.S. Pat. Nos. 5,738,535 or 6,017,227 of Cairns, or in pending U.S. patent application Ser. Nos. 09/641,313 of Barlow et al., filed Aug. 18, 2000, Ser. No. 09/418,145 of Cairns filed Oct. 14, 1999, or 09/761,917 of Cairns, filed Jan. 17, 2001, the contents of which are incorporated herein by reference.

The branching apparatus of this invention is a cylindrical, articulated device designed for direct, in-line installation into a primary oceanic cable, during the process of laying the cable on the ocean floor. A plurality of these devices can readily be installed at spaced intervals along the primary cable, at any points where joining of branch cables may eventually be required to permit increased capacity, either months or years after the initial installation. The structural design of this apparatus, with its inherent flexibility or articulation capability, and minimal bulk, permits it to be readily incorporated in a main cable, manipulated, maneuvered, and deployed, without requiring any modification to, or circumvention of, existing ship-board cable laying equipment.

Some time after deposit on the ocean floor, if the main cable is to be connected to one or more branch cables, or another functional device, an ROV is dispatched to the location of the branching apparatus, As illustrated in FIGS. 11 to 14, the ROV can readily open the housing, disconnect one, two, or more of the pairs of plug units initially in sealed connection with the dummy units, in one or both housing 12, and re-connect them to receptacle units of branch cables or the like. In the deployed condition illustrated in FIG. 3, the dummy units can be readily removed from their respective mounting tubes, and either discarded or retrieved.

The receptacle units 92 of the branch cables 94 can then be installed in the mounting tubes 99 which were previously occupied by the dummy units. The pivotal linkage assemblies are then manipulated to return the plug units and receptacle units to the stowed position, and to return the units into a horizontal and mated condition, as indicated in FIG. 14. The branching or other re-circuiting can be modified or re-configured as often as needed in order to meet future system requirements, such as expanded circuit distribution, improvement in system reliability by addition of parallel or redundant circuits, and installation of repeaters, filters, encryption devices, or other system enhancements for improved system performance.

A key component of this apparatus is the employment of specialized, wet mateable electrical and/or fiberoptic connector sets, which are capable of being mated or disconnected while submerged in sea water, without exposing the electrical/optical circuits to the surrounding sea water, even at oceanic depths of miles below sea level. The use of such underwater mateable connectors in conjunction with the self-contained branching apparatus of this invention greatly enhances the speed and efficiency with which sub-sea cabling can be deposited, expanded, and/or re-circuited to meet new system requirements.

This system is a considerable improvement on current re-circuiting techniques for underwater cables, which require retrieval of the cable from the ocean floor and the use of ship-board equipment to re-terminate the cabling. The prior art technique is extremely laborious, time-consuming and expensive. The apparatus and method of this invention allows standard ship-board cable laying apparatus to be used to initially deploy the cable with the spaced, in-line cable branching modules. After initial deposit on the ocean floor, any subsequent modifications can be carried out easily by an ROV on the ocean floor. This is safer, faster, and less expensive than current techniques, and is also less subject to adverse weather conditions. The cable branching and re-circuiting can be repeated or revised as often as needed to accommodate the changing conditions of the cable system into which the branching apparatus is installed.

The cable branching apparatus of this invention may also be retro fitted into an existing underwater cable. The cable would be retrieved from the ocean floor, fitted with a cable branching apparatus at spaced intervals, and then returned to the ocean floor. All subsequent re-circuiting and branching may then be performed by an ROV on the ocean floor.

Although an exemplary embodiment of the invention has been described above by way of example only, it will be understood by those skilled in the field that modifications may be made to the disclosed embodiment without departing from the scope of the invention, which is defined by the appended claims.

We claim:

1. An ocean floor cable branching apparatus, comprising:

a cable junction housing for positioning in-line between two main cables for installation underwater, the housing having a first junction at one end having a through bore for receiving the end of a first cable and a second junction at the opposite end having a through bore for receiving the end of a second cable;

a circuit distribution unit inside the housing having a first port connected to the end of the first cable, a second port connected to the end of the second cable, and at least two additional, third and fourth ports, a switch assembly in the circuit distribution unit for selectively connecting the first port to the second port in a straight through arrangement, and connecting the first and second ports to the third and fourth ports, respectively;

at least two wet mateable underwater connectors in the housing each comprising a plug unit and a socket unit releasably connected with the plug unit, one of the units comprising a dummy unit and the other unit being connected to a respective one of the third and fourth ports; and a connector mounting mechanism in the housing for movably mounting the respective plug and socket units for movement between an inactive, stowed condition inside the housing in which each plug unit is aligned with and connected to the respective socket unit, and a released, deployed condition in which the plug and socket units are separated, the dummy unit is discarded, and the remaining unit is deployed for selective connection to a mating unit at the end of a branch cable to be connected to one of the main cable ends.

2. The apparatus as claimed in claim 1, wherein the circuit distribution unit has are four additional ports and there are four underwater connectors, each connector having an active unit connected to a respective one of the additional ports and a dummy unit releasably connected to the active unit in the stowed condition.

3. The apparatus as claimed in claim 2, wherein there are two connector mounting mechanisms in the housing, each connector mounting mechanism supporting a respective pair of connectors for movement between the stowed and deployed positions.

4. The apparatus as claimed in claim 1, wherein the connector mounting mechanism comprises a first pivotal linkage assembly for pivotally mounting at least one dummy unit for movement between the stowed position aligned with the active connector unit and an extended position separated from the active connector unit and extending upwardly out of the housing, and a second pivotal linkage assembly for pivotally mounting at least one active unit for movement between the stowed position aligned with the active connector unit and an extended position separated from the dummy connector unit and extending upwardly out of the housing for connection to a mating connector unit at the end of a branch cable.

5. The apparatus as claimed in claim 4, wherein both dummy units are secured to the first pivotal linkage assembly and both active units are secured to the second pivotal linkage assembly for movement in unison between the stowed and deployed, extended positions.

6. The apparatus as claimed in claim 5, wherein the housing has an upper opening for access to the pivotal linkage assemblies, the first pivotal linkage assembly comprises a first arm secured to the dummy units and having opposite first and second ends, a handle secured to the first end of the first arm, a second arm having a first end pivotally secured to the second end of the first arm for rotation about a first pivot axis and a second end pivotally mounted in the housing for rotation about a second pivot axis, and a third arm having a first end pivotally secured to the first arm at a location spaced between the first and second ends of the first arm for rotation about a third pivot axis, and a second end pivotally secured to the housing for rotation about a fourth pivot axis spaced above the second pivot axis, the first, second , third and fourth pivot axes lying at the corners of a parallelogram when the dummy units are in the stowed position and the dummy units being movable into the deployed position by pulling the handle upwardly and out of the housing.

7. The apparatus as claimed in claim 5, wherein the second pivotal linkage assembly comprises a slide mechanism slidably mounted in the housing for movement between an advanced and a retracted position, a first arm having a first end pivotally mounted on the slide mechanism for rotation about a first pivot axis, the active connector units being secured to said first arm, and a second arm having a first end pivoted to said first arm at a location spaced from said first pivot axis for rotation about a second pivot axis and a second end, and a handle assembly pivotally connected to the second end of the second arm for moving the first arm and attached active connector units between a stowed, generally horizontal condition and a deployed, generally vertical condition extending upwardly out of the housing.

8. The apparatus as claimed in claim 5, including two additional wet mateable underwater connectors in the housing positioned side-by-sde with the first two connectors, the circuit distribution unit having additional, fifth and sixth ports each connected to an active unit of a respective one of the additional connectors, and a second connector mounting mechanism for movably mounting the additional connectors in the housing for movement between the stowed and deployed positions.

9. The apparatus as claimed in claim 1, including a second cable junction housing secured in-line with the first cable junction housing, the second housing having a first junction at one end communicating with the second junction of the first housing and having a through bore, and a second junction at the opposite end having a through bore, the second cable extending through the bores in the second junction of the first housing and the first junction of the second housing, and the second junction of the second housing receiving the end of a third cable;

a second circuit distribution unit inside the second housing having a first port connected to the end of the second cable, a second port connected to the end of the fourth cable, and at least two additional, third and fourth ports, a switch assembly in the circuit distribution unit for selectively connecting the first port to the second port in a straight through arrangement, and connecting the first and second ports to the third and fourth ports, respectively;

at least two wet mateable underwater connectors in the second housing each comprising a plug unit and a socket unit releasably connected with the plug unit, one of the units comprising a dummy unit and the other unit being connected to a respective one of the third and fourth ports; and a connector mounting mechanism in the housing for movably mounting the respective plug and socket units for movement between an inactive, stowed condition inside the housing in which each plug unit is aligned with and connected to the respective socket unit, and a released, deployed condition in which the plug and socket units are separated, the dummy unit is discarded, and the remaining unit is deployed for selective connection to a mating unit at the end of a branch cable to be connected to one of the cable ends.

10. The apparatus as claimed in claim 9, wherein each housing has a ball joint arrangement at an outer end, and a central, double ball joint is secured between the two housings for permitting articulation between the two housings and between each housing and the respective first and third cables, each ball joint having a through bore for cable passage into and between the housings.

11. The apparatus as claimed in claim 10, wherein each housing is capable of articulating though at least 90 spherical degrees relative to the other housing.

12. The apparatus as claimed in claim 1, wherein the housing has at least one opening for access to the connectors, and at least one door for normally closing the opening, wherein the door can be opened by a remote oceanic vehicle when the cable ends are to be re-connected to branch cables.

13. A method of releasably connecting the ends of two cables in-line and subsequently separating the cable ends and joining them to branch cables, comprising the steps of:

securing an end of a first cable to a first port of a circuit distribution unit mounted inside a housing;

securing an end of a second cable to a second port of the circuit distribution unit with the circuit distribution unit arranged to connect the first port to the second port;

securing first and second underwater connectors to third and fourth ports of the circuit distribution unit inside the housing, with each connector comprising a port connector unit connected to the respective port and a dummy unit releasably connected to the port connector unit;

deploying the cables and housing underwater as part of a sub-oceanic cable communication network;

at a subsequent date, disconnecting at least one dummy unit from the corresponding port connector unit, and connecting the port connector unit to an end connector of a branch cable; and adjusting the circuit distribution unit to connect the branch cable to one of the cables.

14. The method as claimed in claim 13, wherein both of the dummy units are disconnected from the respective port connector units and discarded, and separate branch cables are connected to the respective port connector units, with the circuit distribution unit being adjusted to connect one of the branch cables to the first cable, and the other branch cable to the second cable.

15. The method as claimed in claim 14, wherein the steps of disconnecting the connector units from the dummy units and re-connecting them to branch cable connector units are carried out underwater by an ROV.

16. An underwater cable branching apparatus, comprising:

a housing having a first cable inlet, a second cable inlet, and an opening for access to the interior of the housing;

a circuit distribution unit in the housing having a first port for connection to a cable extending through the first cable inlet, a second port for connection to a cable extending through the second cable inlet, and at least two additional, third and fourth ports, the circuit distribution unit having a switching assembly for selectively connecting the first port to the second port or the first and second ports to the third and fourth ports, respectively; and first and second wet mateable underwater connectors in the housing each having releasably connected, sealed first and second connector units, one of said connector units comprising a dummy and the other connector unit being connected to a respective one of the additional ports of the circuit distribution unit;

whereby each dummy unit is selectively separable from the other connector unit to permit the other connector unit to be connected to an end connector unit of a branch cable.

* * * * *